United States Patent [19]

Cawley

[11] 4,415,203

[45] Nov. 15, 1983

[54] DENTAL CHAIR

[76] Inventor: Reginald E. Cawley, 24815 Bent Tree La., Lake Forest, Calif. 92630

[21] Appl. No.: 178,612

[22] Filed: Aug. 15, 1980

[51] Int. Cl.[3] ..... A47C 7/36

[52] U.S. Cl. ..... 297/391; 5/441; 297/DIG. 3

[58] Field of Search ..... 297/391, 405, DIG. 3, 297/DIG. 8; 5/441, 437

[56] References Cited

U.S. PATENT DOCUMENTS

| | | | |
|---|---|---|---|
| 361,906 | 4/1887 | Stiles | 297/405 |
| 587,224 | 7/1897 | McKelvey | 297/391 |
| 3,644,949 | 2/1972 | Diamond | 5/441 |
| 3,983,640 | 10/1976 | Cardullo et al. | 297/DIG. 3 |
| 4,017,118 | 4/1977 | Cawley | 297/391 |

*Primary Examiner*—Francis K. Zugel

*Attorney, Agent, or Firm*—Gausewitz, Carr, Rothenberg & Edwards

[57] ABSTRACT

This invention provides a dental chair having a seat, toeboard, and back, the toeboard and back being pivotal relative to the seat. A bladder unit fits on the seat and toeboard, defining a plurality of chambers containing opencelled foam plastic and air at atmospheric pressure, interconnected by narrow passageways. This provides for displacement of the air to the location of low weight when the seat is occupied to provide support behind the knees irrespective of the height of the occupant. At the bottom of the seat back is a pad that includes a bladder which is compressed as the seat back is lowered to be displaced outwardly so that it acts as a lumbar support. At the upper end of the seat back is a pivotal plate beneath which is a bladder which can be inflated to raise the shoulders of the occupant. On the headrest is a head support with a recess complementary to the back of a human head, pivotally connected to a base which in turn rests on three bellows. Selective inflation of the bellows can tilt the head to either side or raise it to move the oral cavity downwardly.

4 Claims, 12 Drawing Figures

10
12
14
15
17
18
20
21
23
33
34
38
39
40
41
42
43
44
54
55
56
57
58
59
65
66
67
68
69
70
73
74
84
85

10
11
12
14
15
16
17
18
53
60
61
62
73
74
76
82
83
84
87
88
89

FIG. 8.
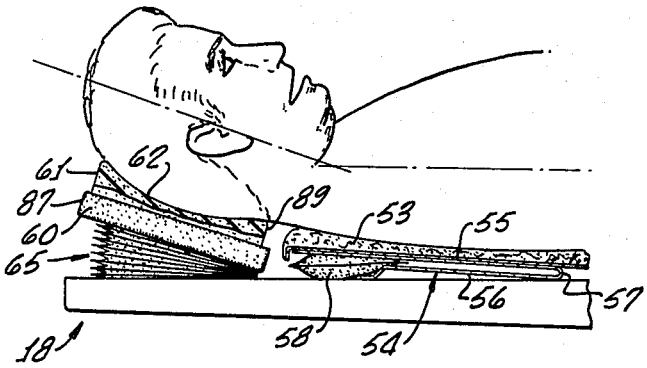
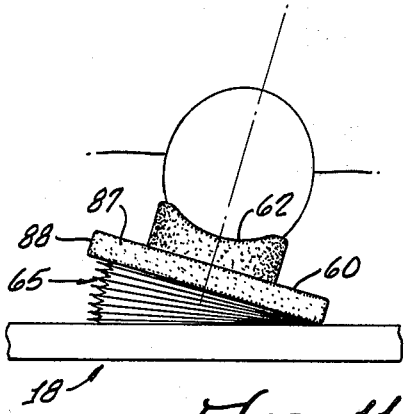
FIG. 11.
FIG. 9.
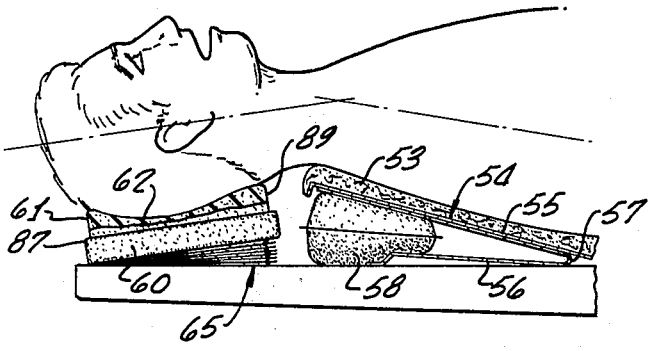
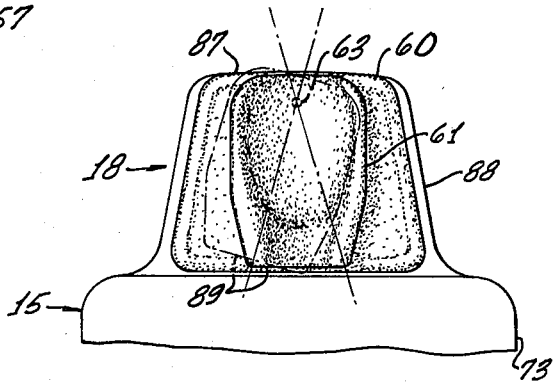
FIG. 10.
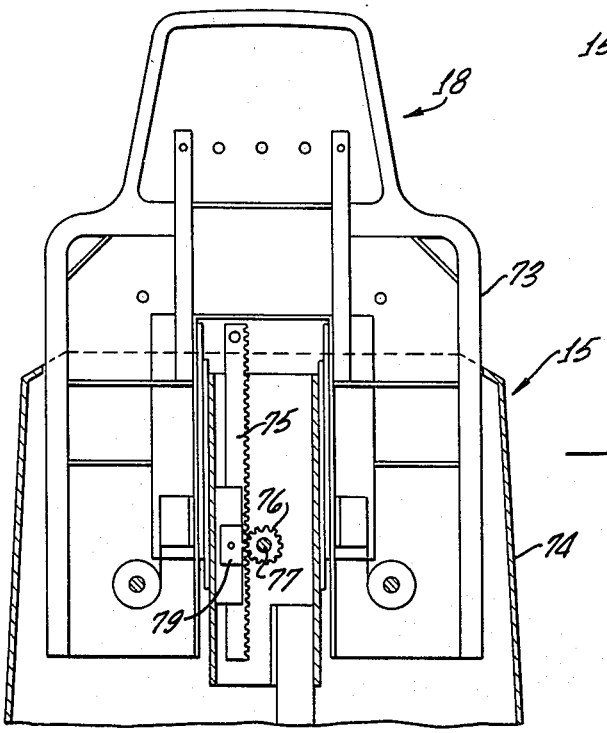
FIG. 12.

DENTAL CHAIR

BACKGROUND OF THE INVENTION

Ideally, a dental chair will provide support for the patient so that he can rest comfortably in the various positions of adjustment of the chair, and will allow the dentist to perform his work with maximum facility and minimum fatigue. The dental chair of my prior U.S. Pat. No. 4,017,118 goes a long way toward achieving these objectives through the use of various air bladders in the chair which support the patient and provide for appropriate movement of the head. However, there has remained room for improvement in optimizing the comfort for the patient and convenience for the dentist, as well as in minimizing the expense of manufacture.

SUMMARY OF THE INVENTION

The present invention provides a dental chair meeting the above-noted objectives. The chair includes a seat portion from one end of which is pivotally connected a toeboard and to the opposite end of which pivotally connects a backrest. Positioned over the seat and toeboard is a bladder unit which defines a series of chambers interconnected by restricted passageways. The chambers are occupied by a resilient open-celled foam plastic material and contain air or other gas at a low pressure, such as atmospheric pressure. As a result of this construction, when the chair is occupied the air is displaced through the bladder assembly from the chambers bearing the most weight to those bearing the least. This provides automatic adjustment of the contour of the seat so that there will be a support behind the knees for a patient irrespective of his height.

At the base of the backrest is a bladder also containing an open-celled foam plastic material and atmospheric air. Upholstery material extends around this bladder and includes two flaps which are attached to the seat and back of the chair. When the back is lowered, the flaps are moved closer to each other, causing them to squeeze the bladder forcing it outwardly. This raises a pad at the base of the back which acts as a lumbar support for the patient. A bleed opening in the bladder allows restricted movement of air out of the bladder as it is compressed and into the bladder when the load is removed.

At the upper end of the back is a pivotal plate beneath which is an additional bladder. The conventional upholstery pad is outwardly of the plate. When this bladder is inflated the plate moves outwardly about a hinge, thereby raising the shoulders of the patient which tilts the chin back to raise the oral cavity.

The headrest includes a head support with a recess generally complementary to the back of a human head, connected by a pivot pin near the top of the headrest to a support base. Beneath the support base are three bellows, selectively inflatable. These bellows provide for substantial outward movement in a minimum of lateral space upon inflation. The bellows can be inflated to tilt the base to the right or to the left to tilt the head to one side or the other, or to raise its outer end for tilting the head downwardly. The base provides a convenient arm rest for the dentist immediately adjacent the patient's head, therefore, reducing the fatigue of the dentist.

The arms of the chair can be pivoted out of the way for getting into and out of the chair.

The chair includes pivotal plates along the side edges of the backrest, which can be moved outwardly when the seat back is lowered, thereby supporting the elbows of the patient.

The seat back is in two sections, the outer section being integral with the headrest. The outer section is adjustable relative to the inner section for positioning the headrest so that it will be engaged comfortably by a patient of any size. This adjustment moves the headrest and outer portion of the backrest together so that in any position of adjustment there is support for the patient's shoulders, unlike conventional designs in which only the headrest moves outwardly and which will leave the shoulders unsupported for a taller person.

BRIEF DESCRIPTION OF THE DRAWINGS

FIG. 8 is a fragmentary sectional view showing the headrest in one position of adjustment and the shoulder support in a restracted position;

FIG. 9 is a view similar to FIG. 5, but with the headrest in a different position of adjustment and the shoulder support extended;

FIG. 10 is a fragmentary plan view of the headrest;

FIG. 11 is an end elevational view of the headrest, tilted to one side; and

FIG. 12 is a sectional view of the interior of the seat back showing the means for adjusting the outer portion of the seat back relative to the inner portion.

DETAILED DESCRIPTION OF THE INVENTION

Figure 4:
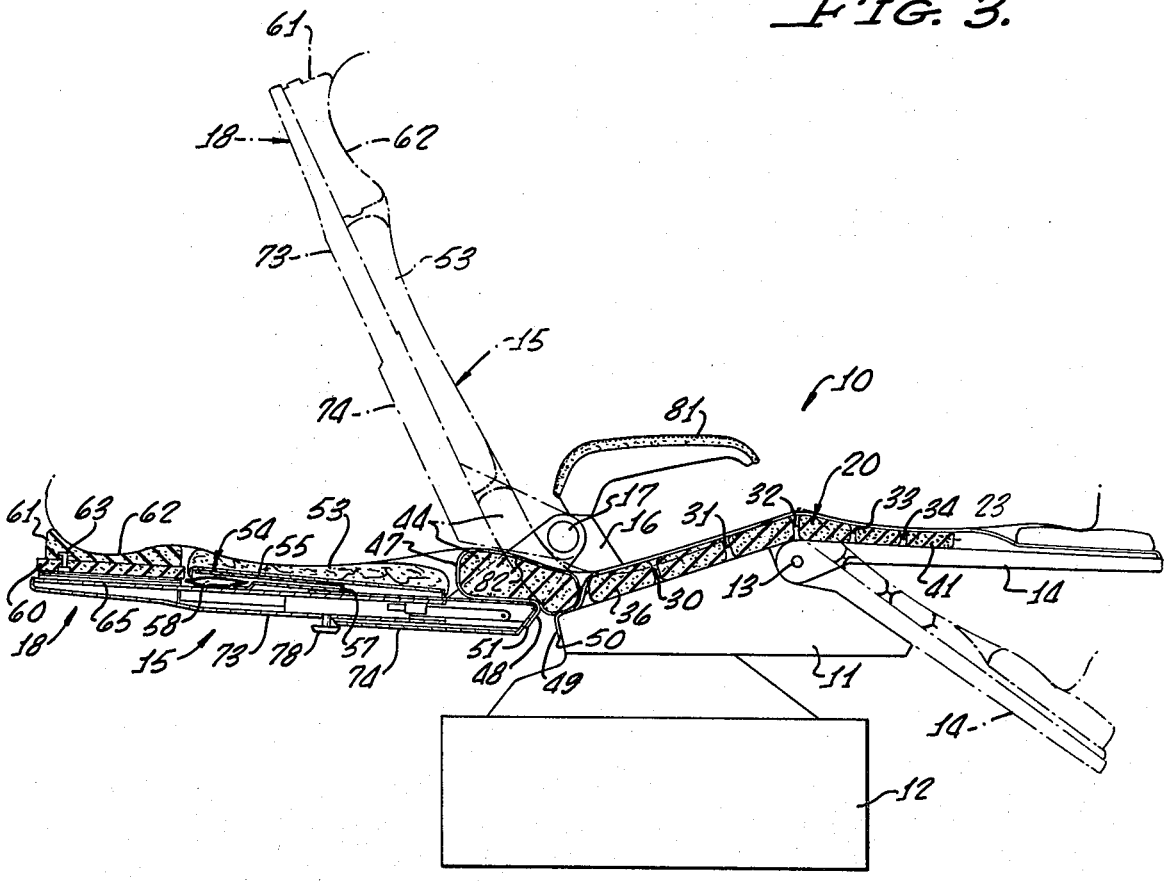
FIG. 4 is a longitudinal sectional view of the chair in the lowered position, with adjusted positions of the back and toeboard shown in phantom.

The dental chair 10 of this invention includes a seat 11 mounted on a base 12. At the outer end of the seat, pivotal about a transverse hinge pin 13, is a toeboard 14. At the opposite end of the seat 11 is a backrest 15 connected to upstanding brackets 16 of the seat assembly by pivot pins 17. This permits the backrest 15 to move between upper and lower positions, as indicated in FIG. 4. At the top of the backrest 15 is a headrest 18.

Figure 1:
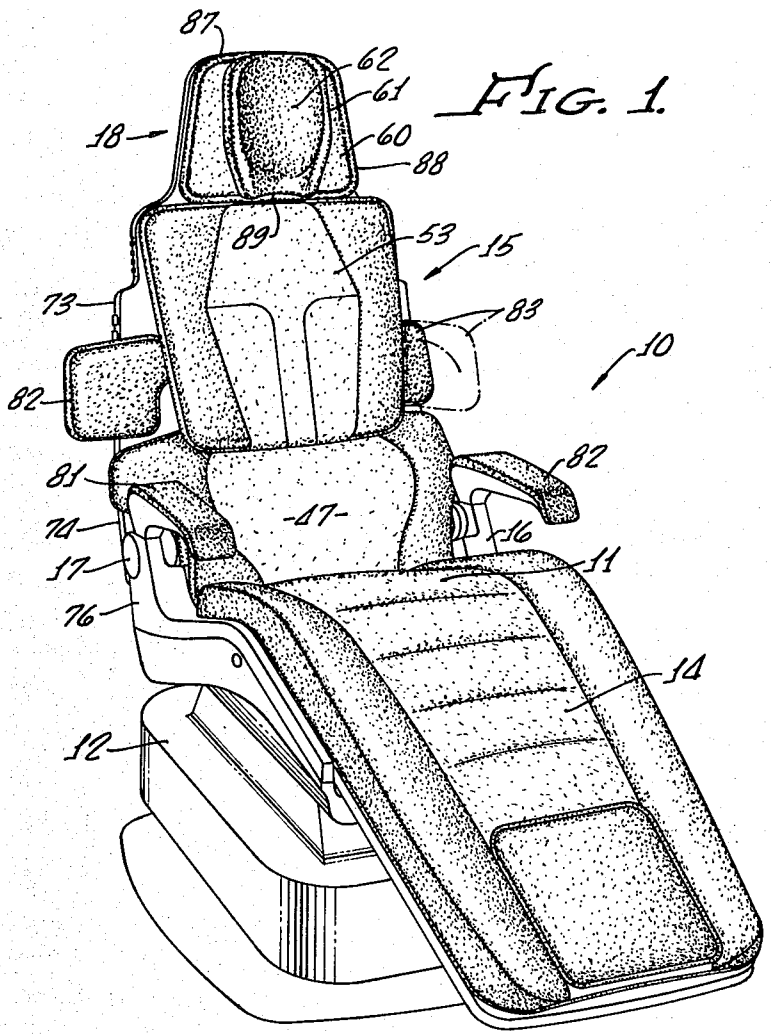
FIG. 1 is a perspective view of the dental chair of this invention.
Figure 3:
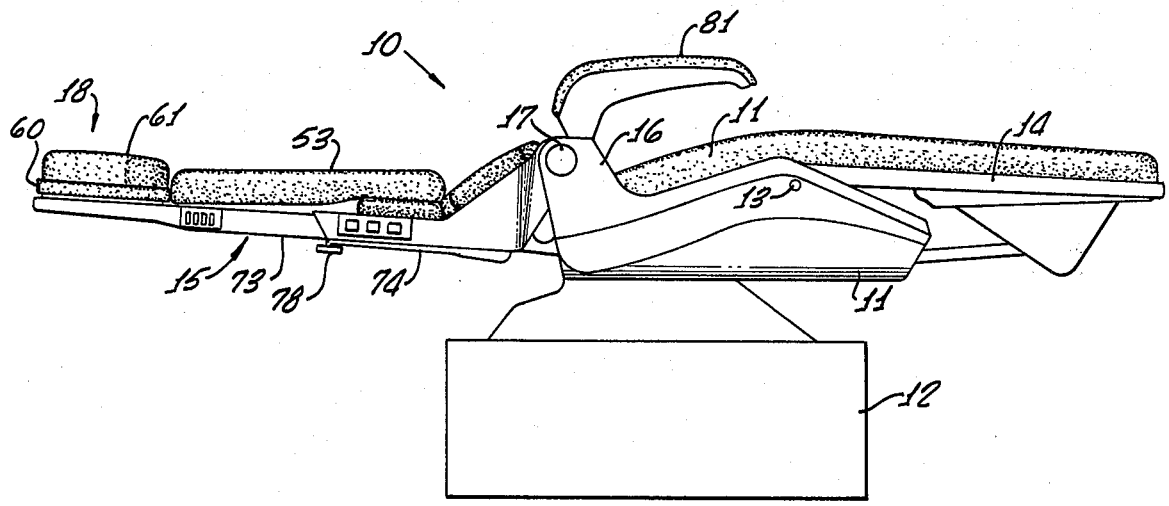
FIG. 3 is a side elevational view of the chair with the back in the lowered position.
Figure 5:
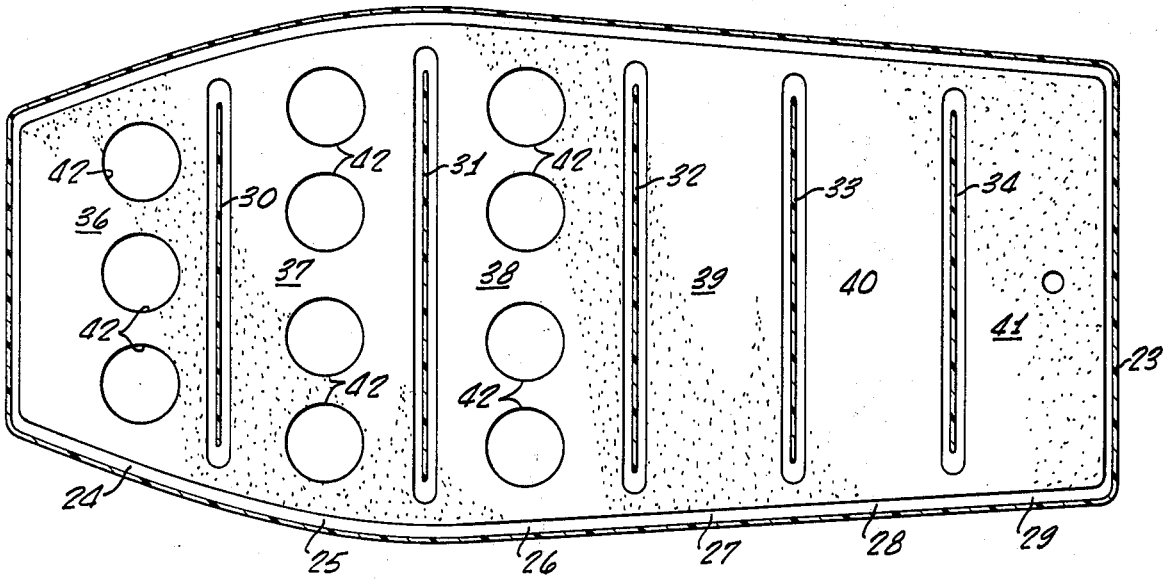
FIG. 5 is a longitudinal sectional view of the bladder unit for the seat and toeboard, taken along line 5—5 of FIG. 2.
Figure 6:
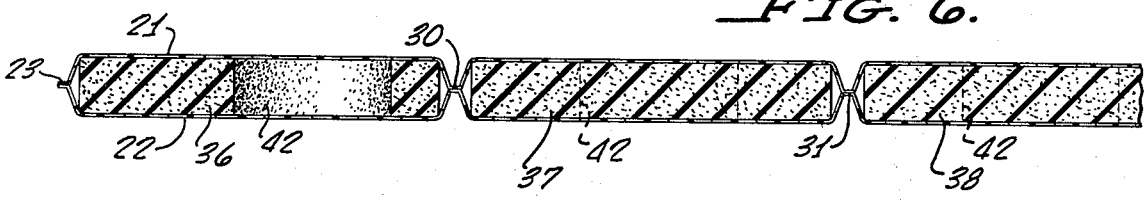
FIG. 6 is an enlarged fragmentary sectional view of the bladder unit for the seat and toeboard.

The toeboard, seat, and back of the chair are upholstered as illustrated in FIG. 1. Beneath the upholstery, extending longitudinally of the chair so that it is located both on the seat 11 and toeboard 14, is a bladder unit 20. This is an enclosed chamber of flexible plastic material made up of upper and lower sheets 21 and 22 attached together such as by heat sealing around the outside perimeter 23 (see FIGS. 5 and 6). Chambers 24, 25, 26, 27, 28, and 29, in series, are formed by transverse seams 30, 31, 32, 33, and 34 where the upper and lower sheets 21 and 22 are joined together. These seams do not extend all the way to the periphery 23, leaving narrow gaps at their ends, which provide restricted communication among the chambers 24, 25, 26, 27, 28, and 29. Complementarily filling these chambers are inserts 36, 37, 38, 39, 40, and 41 of resilient open-celled foam plastic material. Circular cutouts 42 are formed in the inserts 36, 37, and 38, which are positioned on the seat 11.

In the normal position of the bladder 20, the foam plastic material is undistorted and the remainder of the interior of the bladder is occupied by air at atmospheric pressure. In manufacture of the bladder 20, the foam plastic inserts are allowed to reach their free positions and air is permitted to enter, after which a plug 43 in the bladder wall is sealed to trap the air inside.

Figure 7:
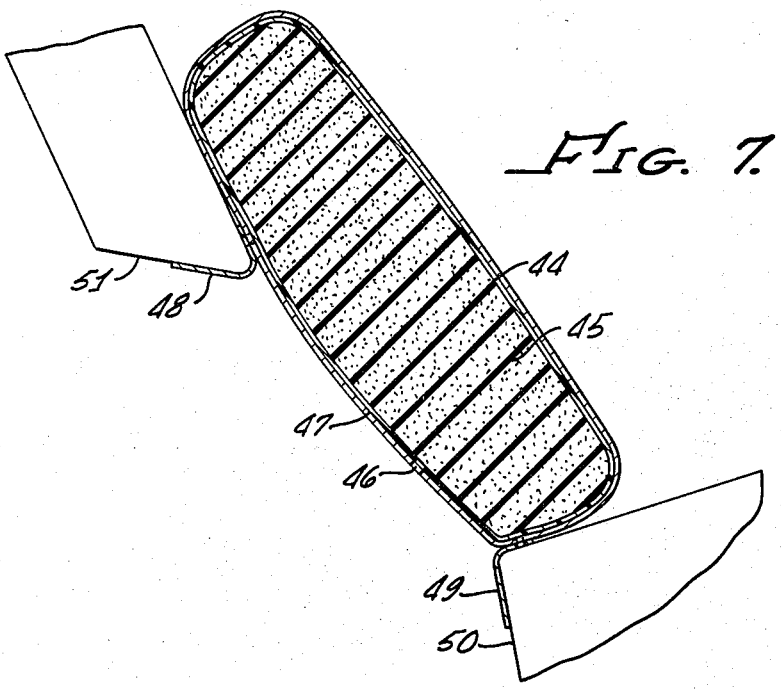
FIG. 7 is an enlarged fragmentary sectional view of the lumbar support.

An additional bladder or pad 44, shown in enlarged detail in FIG. 7, is provided at the lower end of the back 15, with a core 45 of resilient open-celled foam plastic material occupying its interior. The interior of the bladder 44 is at atmosphric pressure, although a small bleed opening 46 permits some air to escape when the bladder is compressed. An upholstery material 47 covers the bladder 44 and on its reverse side are attached two flaps 48 and 49, which extend transversely of the seat back. Velcro fasteners are attached to the flaps 48 and 49. The Velcro fastener of the flap 49 is secured to a mating Velcro fastener on the inner end 50 of the seat 11. The fastener of the other flap 48 mates with a Velcro fastener on the bottom end edge 51 of the seat back 15, which is spaced upwardly and to the rear of the inner end 50 of the seat. This secures the upholstered bladder 44 to the lower portion of the seat back.

An upholstery pad 53 extends outwardly along the seat back above the bladder 44. Beneath this pad, at the outer end of the backrest, adjacent the headrest 18, is a metal plate 54, which is V-shaped in side elevation, It is made up of an upper section 55 and a lower section 56 which is shorter than the upper section and is attached to the structure of the back 15. The connection 57 between the upper and lower sections is bendable to act as a hinge. The opening formed when the sections 55 and 56 are separated faces the outer end of the back 15 so that the hinge connection 57 is spaced inwardly of the outer end of the back. Beneath the upper section 55 at the open end is a transverse bladder 58. This bladder is connected to a source of pressurized air through fittings 59 so that it may be either inflated as seen in FIG. 9 or collapsed as in FIG. 8.

The headrest 18 includes a flat base plate 60 on the upper surface of which is a head support cup 61 of resilient plastic or rubber material. The base plate 60 is wider than the head support 61 and provides a convenient location for the dentist to rest his arms while working on the patient's teeth to reduce fatigue and facilitate his procedures. A central recess 62 in the head support cup 61 is complementary to the typical shape of the back of the human head. Near the top of the head support cup 61 is a pivot pin 63 that connects the head support cup 61 to the plate 60. This permits the head support cup to swing through an arc as indicated in phantom in FIG. 10.

Beneath the plate 60 of the headrest is a bellows assembly 65. This is made up of a plurality of superimposed layers of flexible plastic sheet material appropriately sealed and attached together to form three individual bellows. This includes two spaced lower bellows 66 and 67 adjacent the inner end of the headrest and an upper central bellows 68. The latter bellows is generally triangular in shape having the base of the triangle at the outer end of the headrest. Fittings 69, 70, and 71 allow air to be introduced selectively into the bellows 66, 67, and 68. The sheet material making up the bellows extends beyond the bellows air chambers, but those areas are not inflatable.

The backrest 15 is split to provide an upper portion 73 that telescopes into a lower portion 74. The headrest 18 forms an extension of the upper portion 73. This allows the upper portion of the backrest, above the bladder 44, to be moved outwardly along with the headrest for accommodating taller people. As a result, the shoulders always are supported as the headrest 18 never is extended outwardly beyond the upper portion of the backrest.

The mechanism for moving the upper portion 73 of the backrest outwardly, shown in FIG. 12, includes a rack 75 carried by the upper portion 73 meshed with a pinion 76 on a shaft 77 that is mounted on the lower portion 74. Rotation of the pinion 76 in move the rack 75, and hence the upper portion 73 relative to the lower portion 74, is accomplished by a knob 78 on the rearward side of the seat back 15. After the backrest has been adjusted, pushing inwardly on the knob 78 moves the pinion 76 axially into engagement with a tooth on a fixed plate 79 to one side of the rack 75, thereby locking the outer portion 73 relative to the inner portion 74 of the seat back to prevent further movement.

The two arms 80 and 81 of the chair can pivot outwardly away from the seat to facilitate getting into and out of the chair.

When the chair 10 is occupied the patient sits on the bladder assembly 20 with his legs extending out over the chambers 27, 28, and 29 on the toeboard. The weight of the occupant displaces the air within the bladder assembly 20 through the restricted passageways at the ends of the seams 30, 31, 32, 33, and 34 that interconnect the various chambers. The restricted nature of the passageways causes the flow among the chambers to be gradual to avoid an abrupt change in the contour of the seat. The presence of the foam plastic in the chambers also serves to control the flow of air as well as to give body to the bladder assembly 20. The cutouts 42 increase the volume of air in the chambers 24, 25, and 26 before the chair is occupied.

Most of the weight of the occupant will be imposed on the chambers 24, 25, and 26, which are beneath the buttocks and thighs, displacing the air outwardly toward the toeboard 14. The minimum weight of the occupant is in the space behind the knees so the bladder chamber at that location will become inflated to a greater degree by the air displaced to that chamber from the other chambers. This assures that there will be support behind the knees for the occupant of the chair, greatly adding to the comfort of the occupant. The movement of air to the space behind the knees is automatic as air is displaced from one chamber to the other by the weight of the occupant. This arrangement compensates for the height of the occupant by displacing air to whichever chamber happens to be behind the knees. For example, for a relatively short person the bladder chamber 27 may be behind the knees and become automatically distended when the chair is occupied. For a taller occupant the chamber 28 may fall behind the knees and it will become more greatly pressurized when the chair is occupied, then being the location where the least weight is imposed. This has the effect of adjusting the dimension of the seat of the chair to fit the skeletal frame of the patient.

When the backrest 15 is in its upright position, shown in plantom lines in FIG. 4, little force is imposed on the bladder 44 at the bottom of the seat back. When the back 15 is moved to the lowered position, the bladder 44 becomes distended to provide support for the lumbar region of the occupant. This occurs because pivotal movement of the seat back to the lowered position about the axis defined by the hinger 17 causes the bottom edge 51 of the seat back to be moved closer to the inner edge 50 of the seat portion 11. This, in turn, pulls the flaps of upholstery material 48 and 49 toward each other, thereby causing the layer of upholstery material 47 to compress the open-celled foam material within the bladder 44. As a result, as the bladder 44 is moved to a horizontal position by the movement of the seat back downwardly, it is distended upwardly by the pulling of the flaps 48 and 49 toward each other. This upward movement of the bladder 44 causes it to give support to the lumber 82 of the occupant of the chair. The comfort of the patient is enhanced and the action occurs automatically with the lowering of the seat back. Some air is bled from the bladder 44 as it is compressed and bears the weight of the patient at the lumbar. When the force on the bladder 44 is removed, the foam material 45 restores it to its original shape as some air will enter the bladder through the bleed opening 46.

Figure 2:
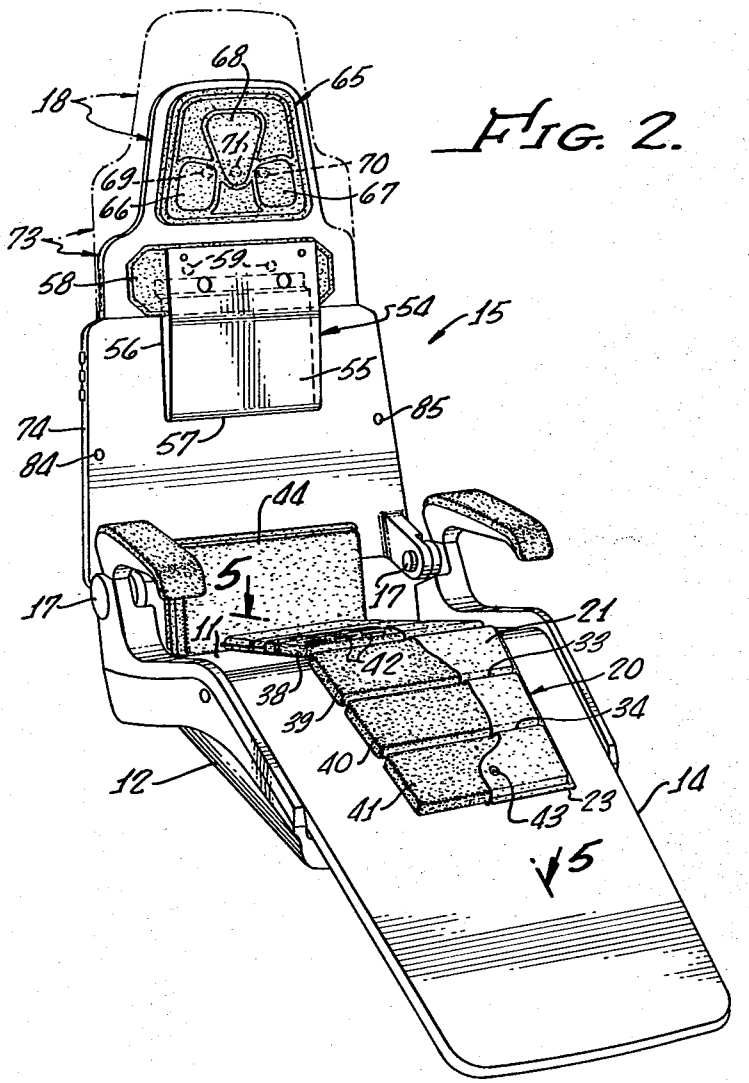
FIG. 2 is a view similar to FIG. 1, but with the upholstery material removed to reveal the inner components of the chair.

When the backrest 15 is in its lowered position, the patient's elbows may be supported by flat plates 83 and 84 which are located on either side of the lower portion 74 of the backrest. These plates are pivotally connected to the backrest at locations 85 and 86, as seen in FIG. 2, and may be rotated between retracted and extended positions as indicated in FIG. 1. When retracted, this facilitates the dentist's getting closer to the patient in a traditional frontal approach.

With the seat back in the lowered position, the bladder 58 may be inflated to pivot the upper plate 55 upwardly about the hinge 57, as seen in FIG. 9. This raises the shoulders of the patient. The result is to tilt the patient's head upwardly, raising the chin and, therefore, raising the oral cavity. This may be desirable for certain dental procedures. A source of compressed air, not shown, is included with a suitable valve to inflate or deflate the bladder 58, as desired.

The patient's head fits comfortably in the complementary recess 62 of the head support cup 61. The head may be moved to various positions to facilitate the work of the dentist by selective inflation of the bellows 66, 67, and 68.

The patient's head is raised, as shown in FIG. 8, by inflation of the bellows 68. This bellows, being primarily beneath the upper portion of the flat base 60 of the headrest 18, lifts the outer end 87 of the base 60 upon its inflation, thereby lifting the outer end portion of the head support cup 61. This lifts the patient's head, lowering his chin. The result is to lower the oral cavity for better access for certain dental procedures.

The head is tilted to one side or the other by the inflation of the bellows 66 wand 67. For example, inflation of the bellows 67 will tilt the patient's head to his right, as seen in FIG. 12, by lifting upwardly on the left side 88 of the base 60, thereby also tilting the head support cup 61. When this movement takes place the head support cup 61 can pivot about the pin 63 located near its upper end. This will allow the inner end portion 89 of the head support 61 to move to the patient's right, as indicated by the phantom line position of FIG. 10. The result is to move the lower portion of the head and hence the oral cavity toward the dentist as the patient's head is tilted. This improves the access by the dentist, facilitating his work upon the patient.

Inflation of the bellows 66 provides the opposite effect from that of inflation of the bellows 67. When the bellows 66 is inflated the patient's head is tilted toward his left side and his chin also is moved in that direction as the head support 61 pivots about the pin 63.

The bellows 66 and 67 at the inner end part of the base 60 may be used together to tilt the inner edge 89 of the head support cup upwardly as seen in FIG. 9. Although not always necessary, this may be done in conjunction with inflation of the bladder 58 beneath the patient's shoulders to help tilt the head upwardly while comfortably supporting the patient.

The use of bellows on the headrest, instead of simple bladders, enables considerably greater movement of the head to be accomplished while keeping the headrest dimensions at a minimum.

The foregoing detailed description is to be clearly understood as given by way of illustration and example only, the spirit and scope of this invention being limited solely by the appended claims.

I claim:

1. A dental chair comprising
a seat,
a back,
and a headrest having an outer part remote from said seat and an inner part adjacent said seat, said headrest including
a head support member having recess means for receiving the back of a human head,
a base member beneath said head support member for supporting said head support member,
pivot means for pivotally connecting the outer part of said head support member to said base member,
and means for tilting said base member from side to side for thereby tilting said head support member from side to side,
said head support member being pivotal about said pivot means upon such tilting for thereby imparting rotational movement to a head supported thereby.

2. A dental chair comprising
a seat,
a back,
and a headrest having an outer part remote from said seat and an inner part adjacent said seat, said headrest including
a head support member having recess means for receiving the back of a human head,
a base member beneath said head support member for supporting said head support member,
pivot means for pivotally connecting the outer part of said head support member to said base member,
and a plurality of air chambers beneath said base member, said air chambers being selectively inflatable for tilting said base member and said head support member,
said head support member being pivotal about said pivot means
upon such tilting for thereby imparting rotational movement to a head supported thereby.

3. A device as recited in claim 2 in which said air chambers are bellows.

4. A dental chair comprising
a seat, a back, and a headrest having an outer part remote from said seat and an inner part adjacent said seat, said headrest including a head support member having a recess means for receiving the back of a human head, a base member beneath said head support member for supporting said head support member, pivot means for pivotally connecting the outer part of said head support member to said base member, first and second bellows beneath the inner part of said base member, said first and second bellows being spaced apart with one of said bellows being adjacent each of the side edges of said base member, and a third bellows intermediate said first and second bellows and extending beneath the outer part of said base member, said first, second and third bellows being selectively inflatable for selectively tilting said base member and said head support member, said head support member being pivotal about said pivot means upon such tilting for thereby imparting rotational movement to a head supported thereby.

* * * * *